United States Patent [19]

Meyer et al.

[11] 4,042,902

[45] Aug. 16, 1977

[54] APPARATUS FOR CONTROLLING TWO CROSSED PROPORTIONAL ADJUSTING DEVICES BY MEANS OF A SINGLE CONTROL STICK

[75] Inventors: Hans Meyer; Werner Käseberg; Horst Eisendick, all of Harsewinkel; Willi Lücke, Greffen-Harsewinkel, all of Germany

[73] Assignee: Firma Simprop-Electronic Walter Claas, Harsewinkel, Germany

[21] Appl. No.: 650,666

[22] Filed: Jan. 20, 1976

[30] Foreign Application Priority Data

Feb. 1, 1975 Germany ..... 2504240

[51] Int. Cl.[2] ..... H01C 10/16

[52] U.S. Cl. ..... 338/128; 338/160; 338/164

[58] Field of Search ..... 338/128, 130, 131, 135, 338/160, 162, 164; 74/471; 200/302

[56] References Cited

U.S. PATENT DOCUMENTS

| | | | |
|---|---|---|---|
| 2,842,645 | 7/1958 | Dalgleish et al. | 338/128 |
| 3,372,359 | 3/1968 | Wilson | 338/128 |
| 3,711,811 | 1/1973 | Oka et al. | 338/128 |
| 3,745,966 | 7/1973 | Seager | 338/128 X |
| 3,760,320 | 9/1973 | Oka et al. | 338/128 |
| 3,939,451 | 2/1976 | Kasahima | 338/128 |

*Primary Examiner*—C. L. Albritton
*Attorney, Agent, or Firm*—Charles E. Baxley

[57] ABSTRACT

This disclosure teaches apparatus for controlling two crossed proportional setting devices by means of a control stick. The control stick is seated firmly at a right angle on a first swivel axis which is supported in a frame swingable around a second swivel axis supported fixedly in the frame to intersect the first swivel axis in the same plane and at right angles thereto. On both swivel axes there are seated firmly radial extensions on the ends of which wiper contacts brush against strip shaped resistors formed in a circular sector around the first swivel axis. The resistors in their turn are fastened to the supporting frame of the first swivel axis.

17 Claims, 12 Drawing Figures

APPARATUS FOR CONTROLLING TWO CROSSED PROPORTIONAL ADJUSTING DEVICES BY MEANS OF A SINGLE CONTROL STICK

BACKGROUND OF THE INVENTION

Devices of this type are known in which a control stick is supported in a universal joint and, below the universal joint, by its extension engages into slots, located one above the other, of two crossed yokes which are supported swingably on extended shafts of the universal joint of the control lever. Outside the yokes these extended shafts form setting shafts of rotary rheostats. Depending on the position of the control stick, corresponding electric values are set in the rheostats. Such devices are used for instance for radio remote control of model aeroplanes as well as other models, but also they are used for controlling electrically operated wheelchairs and for other machines in which a plurality of values are controlled simultaneously and variably in proportion to each other.

In known devices of this type, rotary rheostats are turned with respect to their axes within given ranges by means of a special operating lever in order for instance to set a constant electrical value. In this way, in the case of a remote controlled model aeroplane, a control element can be set with a given deflection in order to achieve desired trim.

Such devices also are already known in which the control stick acts as a so called "open stick" on two crossed pivot shafts, also with use of and guidance in slots of crossed yokes which are seated on the pivot shafts, the pivot shafts being the axes of rotation of rotary rheostats which are arranged in fixed position in the frame. These rheostats can also be set in fixed position by a swing lever in order to give established values of trim.

In these known devices in which only a relatively small range effectively can be utilized in the rheostats (because of swinging motions of their shafts) these rheostats are of relatively small diameter. In the rheostats, wound resistance wires are tapped off by wiper contacts. These resistance wires must be of sufficient thickness, if only because of mechanical stress. Due to relatively short path of the wiper contact, upon a swinging motion in the rheostats of small diameter there thus results a relatively coarse stepwise progression from the transfer from one wire winding to the other end and correspondingly large steps between the individual resistors which are tapped off by the wiper contact. In addition, the electrical values must in this connection be transmitted over two wiper points, namely on the one hand from the resistor to the wiper contact and on the other hand via a wiper ring to the wiper contact. The exact transmission of the roughly produced electrical values thereby becomes problematical and is subject to many disturbances, for instance as a result of dirt.

In the two known embodiments of these devices transfer of mechanical movements of deflection of the control stick over a large number of support points and slot guides, the bearing plays of which are cumulative, and thus due to mechanical conditions, by themselves prevent a given, relatively coarse accuracy in setting from being improved. This accuracy in adjustment also is affected negatively by relatively long transmission paths of mechanical forces, for instance in the slotted yokes, which (consisting of metal) are subjected, for the duration of their use and also under the influence of temperature variations, to deformations which are in part elastic and in part permanent.

Practically all known devices of this type are provided with a zero reset device for the control stick which device causes the control stick to have its position of rest in its central position. This zero return device acts via springs and stops and also is affected in its accuracy by cumulative bearing plays of different mechanical transmission members for movements of the control stick. In the known devices of this type, therefore, the central position of rest of the control stick is surrounded by a region of deflection in which no changes in the electric values are as yet produced.

STATEMENT OF INVENTION

An object of the present invention is to improve an apparatus of this type in such a manner that the zero resetting of the control stick and the transmission of the mechanical movements of the control stick and their conversion into electrical values takes place with substantially greater precision than was obtainable previously.

Another object of the invention is to develop such a device in substantially simpler manner so that also it may be assembled substantially faster in manufacture.

In accordance with the invention a device of the aforementioned type is characterized by the fact that the control stick is seated perpendicularly on a first swivel shaft which is supported in a frame swingable around a second shaft which intersects the first shaft in the same plane and at right angles thereto and is supported in fixed position in the frame, and it is further characterized by the fact that radial extensions are provided on both swivel shafts at the ends of which extension wiper contacts tap or strip shaped resistors or the like which are curved in a circular sector around the shaft and in their turn are fastened to the bearing frame of the associated swivel shaft. Furthermore in accordance with the invention a zero reset device is arranged on both swivel shafts, namely between the bearings and preferably on the bearings arranged in the holding plates of the resistors, said zero reset device consisting of a single armed lever which is swingably supported in the plate and which rests by means of a bearing half shell against the swivel axis on one side and at its free end on the side lying opposite its support with respect to the swivel axis is pulled by a tension spring attached to the plate towards the swivel axis, as well as two pins which are arranged on both sides of the swivel axis to cooperate with the single armed lever upon swinging movements. These two pins are arranged at different distances from the swivel shaft so that, upon swinging movements, they produce identical deflection movements of the single armed lever, which movements are proportional to the rotation, and thus the same restoring forces of the spring.

One important embodiment of the invention is characterized by the fact that the shaft of the single armed lever, the swivel shaft with which it cooperates, as well as the points of application of the pins on both sides of said swivel shafts lie on a line which lies in the plane of the intersecting first and second swivel shafts.

All shaped parts consist of plastic and preferably of fiberglass reinforced polyamide and all rotary shafts and pins consist of steel.

Insofar as reference is had herein to resistors there are concerned electrical variable resistors but other adjustable electrical variables may also be concerned, for instance variable capacitors or the like.

In the apparatus in accordance with the invention the control stick acts exclusively on two crossed swivel shafts which in addition are also provided with a sort of resetting device so that on basis of the considerable reduction in the bearing points and in the movable parts and in the special development of the support in addition to improved ease of motion the play is considerably reduced so that accuracy as compared with known devices of this type both with respect to mechanical movements and with respect to zero resetting is very considerably improved, namely by more than half a power of 10. Furthermore, due to the design in accordance with the invention, the result is obtained that a substantially greater tapping path is available in the case of the variable resistors and that the variable resistors are tapped over their entire lengths. In this way precision of control is on the one hand considerably improved while on the other hand, for instance in the case of wound wire resistors, control steps are substantially smaller than heretofore. Furthermore, transfer of the electrical values takes place only via a wiper contact and no longer via an additional wiper ring. By utilizing the entire length of the variable resistors there is also the possibility of employing a special characteristic curve for them and the tapping curve can be varied externally by additional electric resistors or directly by the shaping of the resistor, for instance in the form of an S-shaped curve.

BRIEF DESCRIPTION OF DRAWINGS

The invention will be described in further detail below on the basis of an illustrative example, with reference to the drawings in which.

DESCRIPTION OF PREFERRED EMBODIMENT

Figure 1:
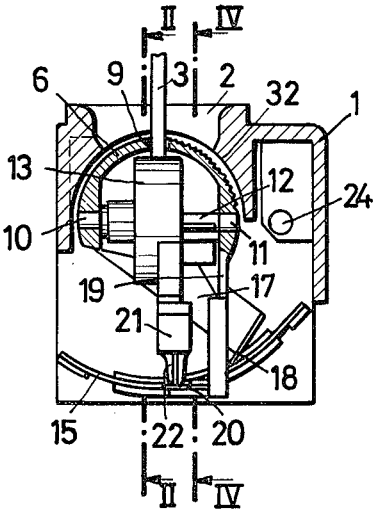
FIG. 1 is a cross section along line I—I of FIG. 2.
Figure 2:
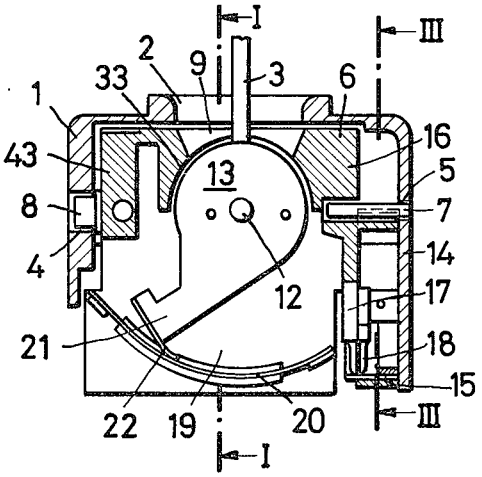
FIG. 2 is a longitudinal section along line II—II of FIG. 1.
Figure 3:
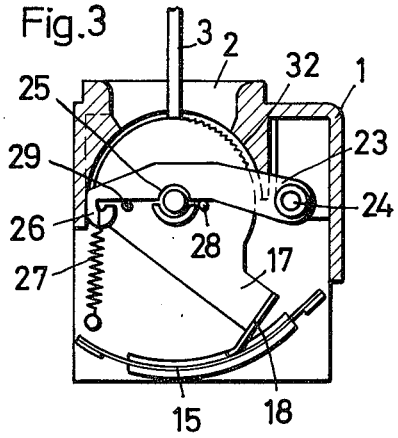
FIG. 3 is a cross section along line III—III of FIG. 2.
Figure 4:
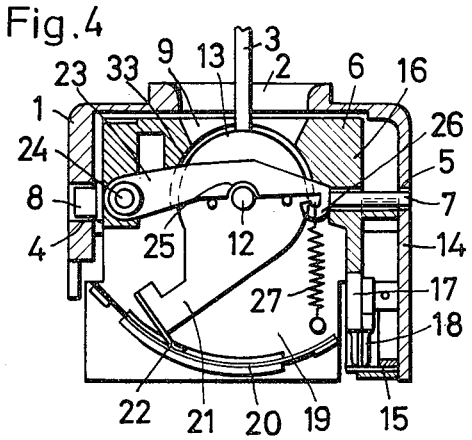
FIG. 4 is a longitudinal section along line IV—IV of FIG. 1.

First of all, it may be pointed out that devices of this type, in view of the general conditions for their installation, must not exceed certain dimensions or a desired total size. The device in accordance with the invention satisfies this requirement; it is constructed of individual parts which consist of plastic, merely the bearings being developed as steel pins.

A housing or a base frame is developed as a box 1 which is open towards its bottom and has a square opening 2 on the top for the movements of a control stick 3. In this box 1 in the opposite shorter side walls there are provided supports 4 and 5 in the form of holes which are aligned with each other.

A frame 6 is supported swingably in the supports 4 and 5, namely by means of a steel pin 7 in the support 5 and by means of a pin 8 formed thereon in the case of the support 4. The frame 6 is developed as a semicylinder whose cylinder axis coincides with the axis through the supports 4 and 5. This frame 6 which is developed as a semicylinder is provided in the center of the arch on its top with a slot 9 extending parallel to the cylinder axis for the passage of the control stick 3. The frame 6 which forms a semicylinder is provided at approximately equal distance from its two ends, in the plane of the swivel axis established by its supports 4 and 5 with bearings 10 and 11. In these bearings 10 and 11 there is supported a shaft 12 on which there is firmly seated a circular disk 13. To this circular disk 13 there is fastened (inter alia) the control stick 3 which extends upwardly through the slot 9 and the approximately square opening 2 of the box shaped housing 1.

The shaft 12 of the circular disk 13 forms a first swivel axis which intersects the axis 7,8 of the semicylindrical frame 6, this latter axis forming a second swivel axis. Both swivel axes lie in a plane to which the control stick 3 is perpendicular in its position of rest.

A preferably narrow side wall 14 of the box shaped housing 1 is extended to about double the depth and forms the mount for a strip shaped resistor 15 which is developed as a curve, namely a circular arc the center of which forms the second swivel axis with the supports 7 and 8 for the semicylindrical frame 6. This frame 6, which is swingable about the second axis, is provided on the wall thereof adjacent the housing wall 14 with the radially extending projection 17 to the outer end of which there is fastened a wiper contact 18 which rests against the curved strip resistor.

One longitudinal side 19 of the semicylindrical swivel frame 6 is extended in the form of a flat plate to about twice the depth and bears at its end a strip shaped resistor 20 which is curved along a circle the center of which is the swivel axis 12, and therefore the first swivel axis, of the circular disk 13. On the circular disk 13 there is developed a radial extension 21 on the end of which there is a wiper contact 22 which rests against the curved strip shaped resistor 20.

From the above description it can be noted that the control stick 3 is swingable freely in all directions around the crossed axes namely around the first swivel axis 12 and around the second swivel axis 7,8 within the square cutout 2. In this connection, the wiper contacts 18 and 22 are moved on the associated strip resistors 15 and 20 from one end thereof to the other, over a relatively long path due to the transmission ratio resulting from the extensions 17 and 18, so that there is obtained a high degree of resolution of the adjustment movement into electrical values with a very fine gradation. In accordance with one practical embodiment there are used for a strip resistor wires which have a diameter of 0.045 mm. The wound length of the strip resistors is 26 mm so that over this tapping length there results a resolution of 0.2%, this applies for a swinging motion around the first swivel axis as well as around the second.

In order to obtain a position at rest of the control stick in the center of the square cutout 2 of the box shaped housing 1, a zero reset device is provided for both swivel axes. In the space between the closure frame 16 of the frame 6 and the side wall 14 of the box shaped housing 1 which is extended to double the depth and in the space between the side wall of the semicylindrical frame 6 which is extended as a flat plate 19 and the adjacent outer surface of the circular disk 13, separate zero reset devices are provided. These devices consist, in accordance with FIGS. 3 to 6, of single armed levers 23 one of each thereof being pivoted to a pin on the side wall 14 of the housing and one to a pin on the flat plate of the swivel frame 6. These journal pins are designated 24. The lever 23 is provided on its bottom with a bearing half shell 25. This bearing half shell presses at the lever arranged on the housing wall 14 against the second swivel axis 7 within its support 5 and therefrom between the two support points 4 and 5 of the second swivel axis. The bearing shell 25 of the lever 23 which is arranged on the inside of the flat plate 19 comes from above against the first swivel axis 12, also between its support points 11 and 10 in the semicylindrical swivel frame 6, namely adjacent the support point 11.

At its free end opposite its support 24 the lever 23 is provided with a downward bent hook 26 in which a tension spring 27 is hooked, the other end of which is fastened to the plate on which the support 24 of the lever 23 is seated. This tension spring 27 urges the single armed lever 23 together with the bearing half shell 25 against the first or second swivel axis and in this way the play of these swivel axes in their support is eliminated.

On the swingable parts arranged on the corresponding single armed levers 23, namely on the outer surface of the wall 16 of the semicylindrical frame 6 on the one hand and on the one outer surface of the circular disk 13 on the other hand there are provided two pins namely an inner pin 28 which is seated between the lever support 24 and the bearing half shell 25 developed in the lever and an outer pin which is seated between the bearing half shell 25 developed in the lever and the hook 26.

Figure 5:
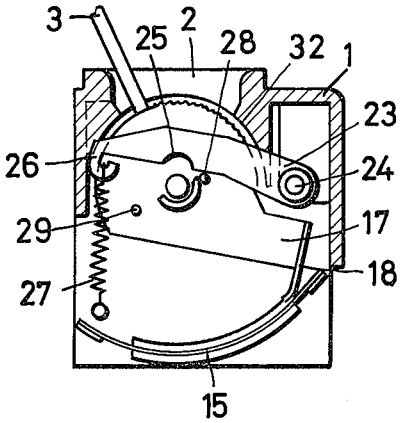
FIG. 5 is a cross section corresponding to FIG. 3 shown in a different position.
Figure 6:
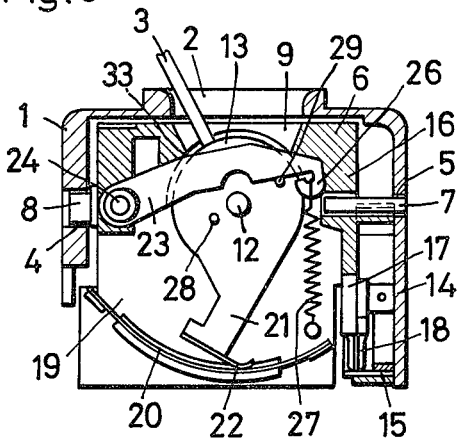
FIG. 6 is a longitudinal section corresponding to FIG. 4 shown in a different position.
Figure 7:
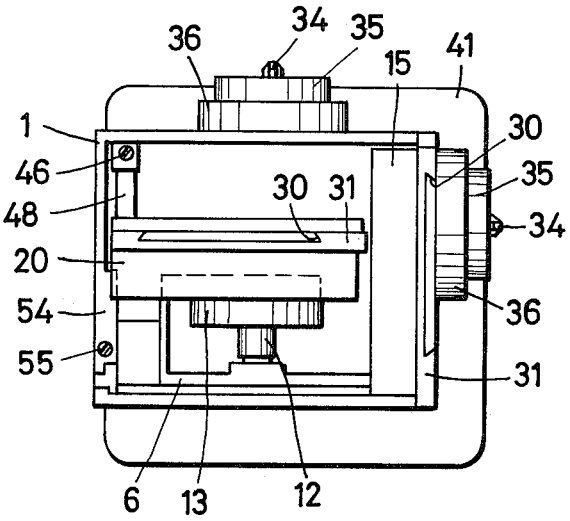
FIG. 7 is a bottom view.

The inner pin 28 is seated closer to the corresponding swivel axis against which the bearing half shell 25 rests than the outer pin 29 is. The arrangement is such that upon the turning of the corresponding swivel part by means of the control stick 3 one of the two pins 28 or 29 presses against the swivel lever 23 and raises the latter with the tensioning of the spring 27, as shown in FIGS. 5 and 6. In this connection the different distance of the inner and outer pins 28 and 29 respectively from the corresponding swivel axis results in a movement of deflection of the single armed lever 23 which is equal to the swinging motion of the control stick. In each direction of movement of the control stick therefore, with an increase in the distance from the central position, the spring 27 is tensioned in the same manner so that the restoring torque is proportional to the outward movement of the control stick. In the central zero position of the control stick 3 the points of rest of the pins 28 and 29 as well as the support 24 of the single armed lever 23 lie in the plane of the first and second swivel axes.

From the above description it can be noted that there is present a very simply constructed zero reset device for the control stick which returns the control stick reliably into the zero position from all deflected positions, the restoring force increasing proportionally to the outward swinging movement of the control stick, but with the same outward path of the control stick being always the same regardless of the direction of the outward swinging motion. In addition to this the zero reset device effects an elimination or at least a considerable reduction of the bearing play of the rotary shaft.

From the above description it can be noted that only two supported rotary shafts are present, the bearing play of which is in addition further eliminated by a special device.

In this way the result is obtained that mechanical precision of the movements and accuracy of resetting is improved considerably, with ready movability and self-adjustment, over previously known devices of this type. A further improvement is obtained in the manner that the zero devices which at the same time act as selfadjustments are arranged for instance in the same plane as the wiper contacts 18 and 22 so that their tapping precision is retained even in case of possible wear of the bearings.

Since the mounts for the strip resistors are arranged on extended wall plates, there is the possibility in accordance with the invention not only of developing these strip resistors 15 and 20 for both directions in similar manner but also in making their mounts replaceable in simple manner. For this purpose the corresponding extended parts of the walls 14 and 19 are provided at their end with recesses and dovetail guides 30. Over these dovetail guides 30 there is placed a plate shaped protruding part 31 which is provided with a shape which mates the dovetail guide 30 and on which the strip shaped resistors 15 and 20 are fastened. It is thus not only possible easily and simply to replace any strip resistors which may have become damaged but also to insert strip resistors having a different control characteristic curve. This strip resistor 20 which is seated on the swingable frame 6 is provided with a flexible current lead so that transmission via slip ring contacts with the disadvantages inherent therein is eliminated for this single moved resistor of the device.

In order to obtain greatest possible covering of the square cutout 2 in the top of the box shaped housing 1 and thus prevent the danger of the penetration of dirt, the box shaped housing 1 is developed on the inner surface of its top side as a cylindrical half shell 32. This cylindrical half shell surrounds the lower edge of the square cutout 2. The axis of this cylindrical half shell 32 coincides with the second swivel axis and with the axis of the semicylindrical swivel frame 6. Between this semicylindrical shell 32 and the outer surface of the semicylindrical swivel frame 6 there is only a very small amount of clearance. This clearance can still be bridged over for instance by a short pile velvet which is bonded onto one of the facing surfaces.

The inside of the semicylindrical swivel frame 6 is developed in the vicinity of the slot as a cylindrical half shell 33 whose cylindrical axis coincides with the first swivel axis 12. Here also the distance between this cylindrical shell 33 and the outer surface of the circular disk 13 is very small and one of the two surfaces can also be covered with a short pile velvet. By this development dirt is prevented from penetrating into the apparatus from above.

Figure 9:
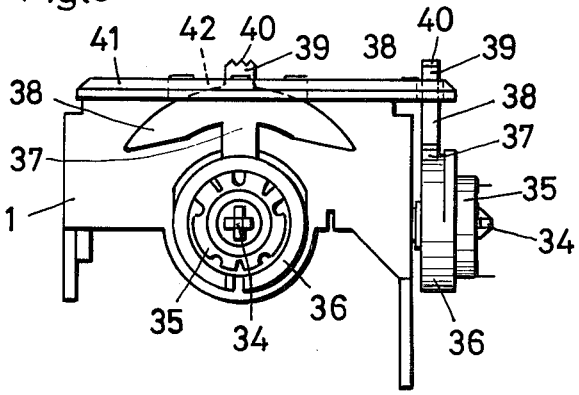
FIG. 9 is a front view with additional rheostats attached.

FIG. 9 is substantially a front view of the box shaped housing 1. On the outside of this housing there are formed, on at least two outer sides which are at right angles to each other, pins 34 which preferably are of an X-shaped cross section. On these pins 34 there are placed rotary resistors 35 whose housing and thus its resistance windings, are turnable around the pins 34. The wiper contacts which cooperate with the resistance windings are accordingly seated on the mounting pins.

On the cylindrical outer surfaces of these rotary resistors there are placed setting devices which consist of a clamp ring 36 on which there is formed a radially upward extending protrusion 37. This protrusion 37 bears, at a distance from the clamping ring 36, circular ring sectors 38 extending towards both sides, whose center point coincides with the center point of the clamping ring 36. Above the circular ring sectors 38 the extension 37 is lengthened somewhat as setting knob 39 with a notching 40 on its outer surface. On the box shaped housing 1 there is fastened a cover plate 41 which extends beyond said housing on all sides and serves also as cover for the insert. This cover plate 41 is provided above the rotary resistors 35 with a slot 42 which is parallel to the underlying wall of the box 1 and extends at a distance therefrom, the upper part of the setting knob 39 extending through said slot and it being covered from the bottom by the circular ring sectors 38 which are formed on the bottom of the setting knob. It can be seen that by this device the rotary resistors 35 can be displaced a certain amount in both directions. As already stated at the start, the displacements of the rotary resistors are used for instance to adjust a given position of trim in the case of a model aeroplane. In the apparatus in accordance with the invention, in accordance with the above description a separate rotary resistor is provided in each case for the adjustment of the trim, as required for the action on different control elements and thus also in multiple arrangement, each one of these rotary resistors being arranged in a corresponding manner, i.e. with its setting device 39 parallel to the corresponding movements of the control stick 3 on the device. In this way there is obtained inter alia the advantage that the range of adjustment of the rotary resistors 35 can be utilized over a wide adjustment path and that thereby the control path of the actual control resistors 15 and 20 is in no way affected. These strip resistors 15 and 20 are replaceable, for instance by resistors having different control characteristic curves, as already described, and this possibility of replacement is made possible by the fact that the rotary resistors 35 for the setting of fixed predetermined values are arranged separately and independently thereof.

Figure 10:
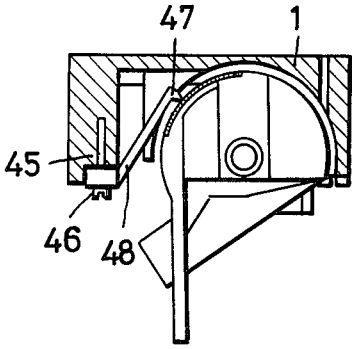
FIG. 10 is a detailed section with a ratchet.

It may be desired for one of the movements of the control stick 3 to be provided with a special restraint which, while it does not substantially interfere with displacement of the control stick, nevertheless has the result that the control stick will remain in a given angular position in which it has been set. Corresponding to FIG. 10 the semicylindrical frame 6 is for this purpose for instance provided with an axis parallel extending knurling 44 on the cylindrical surface of its end wall 44 opposite the end wall 16. In the box shaped housing 1 opposite this knurling 44 there is developed a mount 45 on which a ratchet 47 having a spring elastic extension arm 48 is adapted to be fastened by means of a screw 46. As can be noted, the ratchet 47 rests against the knurling 44 and its tip engages into the grooves of this knurling. On basis of its elastic application, the ratchet upon the displacement of the control stick 3 jumps in each case from one groove into the next of the knurling and holds the control stick in the angular position set when it is not moved. Upon the application of the ratchet 47 the tension spring of the zero reset device which is associated with the corresponding swivel motion is preferably disconnected; in this case this is the tension spring 27 in FIGS. 3 or 5. The arrangement is such that the ratchet 47 after the loosening of the screw 46 can be swung laterally into position of rest so that it is not lost.

Figure 11:
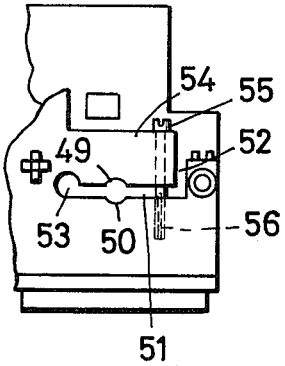
FIG. 11 is a side view with one support.
Figure 8A:
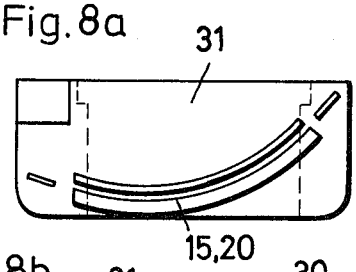
FIGS. 8*a* and 8*b* show details of the replaceable resistor mountings.
Figure 8B:
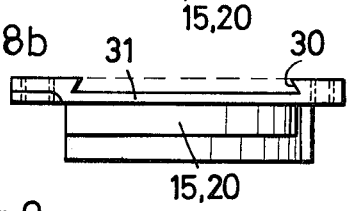

Another possibility of fixing the control stick in a desired angular position in one of the two directions of swing will be explained with reference to FIG. 11. As already described, the semicylindrical frame 6 is supported on one side, namely the side having a closure wall 43, by a pin 8 formed thereon in the bearing 4. This bearing 4 is developed, corresponding to FIG. 11, as a slot bearing, i.e. it is developed in the form of two bearing shells 49 and 50 on a slot 51 which is cut in the plane of the first and second swivel axes into the side wall of the housing 1 with a slot shaped connection 52 to the upper edge of said side wall. The slot 51 is extended behind the two bearing shells 49 and 50 by a distance 53 and rounded off at its end. Parallel to the connecting slot 42 which leads to the upper edge of this side wall there is inserted in the upper part of the side wall which forms a tongue 54 a screw 55 which passes through the slot 51 and engages below the slot 51 into a threaded hole 56 of the side wall. It can be seen that by tightening and loosening the screw 55 the tongue shaped part 54 of the side wall of the housing can be displaced under elastic resilience with narrowing or widening of the slot 51, the bearing shells 49 and 50 being pressed against each other or released from each other with a corresponding application against the pin 8 of the frame 6. By means of the screw 55 therefore the bearing friction on the pin 8 can be adjusted and thus a corresponding retention produced for the movement of the control stick so that while the latter is movable it remains however in the angular position in which it has been set. In this case also the tension spring 27 associated with this movement is advisedly attached to the zero reset device, i.e. in this case the tension springs 27 in FIGS. 3 and 5. Of course in the same manner a retention of the swinging motion can also be produced for the control stick in the movement lying transverse thereto. For this purpose the one bearing, preferably the outer bearing in the semicylindrical frame 6 is developed in the same manner as the one shown in FIG. 11. For this purpose advisedly a pin is formed on the circular disk 13 for this support and the bearing 10 is provided with a slot which also extends at right angle upwards to the edge of this wall of the frame 6 and is provided with an adjusting screw 55. If a restraining of the movement of the control stick is to be produced thereby, the associated return spring of the zero resetting device for this movement is preferably disconnected, i.e. the tension spring 27 in FIGS. 4 and 6.

On basis of the fact that the apparatus in accordance with the invention is developed out of only a few parts with very few bearing points not only are its functions as explained considerably improved with respect to adjustment accuracy and precision as well as ease of motion but manufacture and assembly are greatly simplified. For assembly the parts need only be connected to each other by a few bearing pins and in addition by the insertion of a few screws. It is possible to reduce the assembling time to about one tenth or less that required by the previously known devices of this type.

It will be understood by those familiar with apparatus of this kind that wide deviations may be made from the described embodiment, without departing from a main theme of invention set forth in claims which follow.

We claim:

1. Apparatus for controlling two crossed proportional setting devices comprising a housing (1) having an open bottom, a top whose inner surface is in the form of a cylindrical half shell (32) and is provided with a square opening (2) and two opposed sidewalls (14), a bearing means (4, 5) in each of said two opposed sidewalls, a frame (6), said frame including pivot means (7, 8) engaging said bearing means for constraining the frame to pivot about a first swivel axis, bearing and shaft means (10, 11, 12) rotating about a second swivel axis orthogonal to said first swivel axis, and coincident with the axis of the cylindrical half shell, said first and second swivel axes being parallel to the top of said housing, a first strip resistor (15) formed in a circular sector about said first swivel axis, said first strip resistor being mounted on one of said opposed sidewalls, a second strip resistor (20) formed in a circular sector about said second swivel axis, said second strip resistor being mounted on said frame, a first radial extension element (17) extending from said pivot means (7, 8), a first electrical wiper contact (18) at the end thereof for brushing against said first strip resistor (15), a second radial extension element (21) extending from said shaft means (12), a second electrical wiper contact (22) at the end thereof for brushing against said second strip resistor (20), and a control stick (3) fixed to said shaft means (12) at a point which is defined by the intersection of the first and second swivel axes, said control stick extending upward through the opening in said housing and orthogonal to both of the swivel axes.

2. Apparatus according to claim 1, characterized further by the fact that the frame (6) which is pivotable about the first swivel axis is developed as a semicylinder of smaller radius than the cylindrical half shell (32).

3. Apparatus according to claim 2, characterized further by the fact that there is provided a slot (9) extending parallel to the first swivel axis (7, 8) as passage for the control stick (3) in the semicylinder frame (6) in the center of the arch on the top side.

4. Apparatus according to claim 2, characterized further by the fact that one longitudinal side of the semicylinder frame (6) is extended as a flat plate (19) to about twice the depth as mount for one of the strip shaped curved resistors (20).

5. Apparatus according to claim 2, characterized further by the fact that the bearing means (10, 11) for the shaft means of the second swivel axis (12) is arranged in the semicylinder frame (6) at approximately the same distance from the two ends and in the same plane as the first swivel axis (7, 8).

6. Apparatus according to claim 2, characterized further by the fact that a cylindrical half shell (33) whose axis coincides with the second swivel axis (12) is developed in the semicylinder frame (6), surrounding the passage slot (9) for the control stick (3).

7. Apparatus according to claim 1, characterized further by the fact that the second swivel axis (12) is coaxially surrounded by a thick circular disk (13) whose radius is slightly less than the cylindrical half shell (33) which surrounds the passage slot (9) in the semicylinder frame (6).

8. Apparatus according to claim 1, characterized further by the fact that there are provided mounting plates (14 and 19) for the strip resistors (15 and 20), on each mounting plate a zero resetting device consisting of a single armed lever (23) which is supported swingably in the plate (14, 19) and which rests via a bearing half shell (25) against the swivel axis on one side and at its free end on the side opposite its support (24) with respect to the swivel axis is pulled by a tension spring (27) connected to the plate (14, 19) against the swivel axis, and two pins (28, 29) which are arranged on both sides of the swivel axis for cooperation with the single armed lever (23) upon swinging motions.

9. Apparatus according to claim 8, characterized further by the fact that the two pins (28, 29) are arranged at different distances from the swivel axes (7, 8, 12) so that upon swinging motions they produce equal deflection motions of the single armed lever (23) proportionally to the turning and thus equal restoring forces of the spring (27).

10. Apparatus according to claim 8, characterized further by the fact that the axis (24) of the single armed lever (23) the swivel axis (7, 8, 12) with which it cooperates, as well as the points of application of the pins (28 and 29) on both sides of said swivel axis lie in a line which lies in the plane of the intersecting first and second swivel axes.

11. Apparatus according to claim 8, characterized further by the fact that at least one of the bearings of the swivel axes (7, 8, 12) on which no zero reset device is arranged is developed as a bearing shell (49, 50) in an open slot (51) with a clamping screw (55) bridging over the slot (51) in order to adjust the bearing friction.

12. Apparatus according to claim 2, characterized further by the fact that on one end of the cylindrical surface of the frame there is a paraxial knurling (44) against which a ratchet (47) lies under spring pressure, said ratchet (47) being fixedly supported to the frame.

13. Apparatus according to claim 11, characterized further by the fact that the support of the ratchet (47) is fixed to the frame and is disconnectable whereby the ratchet can be swung away.

14. Apparatus according to claim 3, characterized further by the fact that the surfaces of cylindrical half shell (32) and the semicylinder frame (6) in the region of the passage slot (9) are covered with a short-pile velvet material as protection against the entrance of dirt.

15. Apparatus according to claim 1, characterized further by the fact that on the housing (1) there are formed outside pins (34) protruding from the surfaces, said pins forming fixed pivot shafts for rotary resistors (35) mounted thereon.

16. Apparatus according to claim 15, characterized further by the fact that swing levers (37, 39) pass through a cover plate (41) in slots (42) and are fastened to a rotary resistor (35).

17. Apparatus according to claim 4, characterized further by the fact that the plates (14, 19) which are extended to about double depth are split, an outer end (31) which bears the curved strip resistor (15, 20) being adapted to be attached to the plate by means of a dovetail guide (30).

* * * * *